US006533646B2

(12) United States Patent
Volodarsky

(10) Patent No.: US 6,533,646 B2
(45) Date of Patent: Mar. 18, 2003

(54) POLISHING HEAD WITH REMOVABLE SUBCARRIER

(75) Inventor: Konstantin Volodarsky, San Francisco, CA (US)

(73) Assignee: Lam Research Corporation, Fremont, CA (US)

( * ) Notice: Subject to any disclaimer, the term of this patent is extended or adjusted under 35 U.S.C. 154(b) by 159 days.

(21) Appl. No.: 09/745,653

(22) Filed: Dec. 21, 2000

(65) Prior Publication Data

US 2001/0000774 A1 May 3, 2001

Related U.S. Application Data

(62) Division of application No. 08/838,381, filed on Apr. 8, 1997, now Pat. No. 6,244,946.

(51) Int. Cl.[7] ..... B24B 7/22
(52) U.S. Cl. ..... 451/41; 451/307; 451/388
(58) Field of Search ..... 451/307, 288, 451/287, 41, 398, 388

(56) References Cited

U.S. PATENT DOCUMENTS

| | | | |
|---|---|---|---|
| 2,606,405 | A | 8/1952 | Ohl |
| 3,579,916 | A | 5/1971 | Boettcher |

(List continued on next page.)

FOREIGN PATENT DOCUMENTS

| | | | |
|---|---|---|---|
| EP | 0 284 343 | A3 | 9/1988 |
| EP | 0 362 811 | A3 | 4/1990 |
| EP | 0 589 433 | A1 | 3/1994 |
| EP | 0 747 167 | A2 | 12/1996 |
| EP | 0 768 148 | A1 | 4/1997 |
| EP | 0 841 123 | A1 | 5/1998 |
| EP | 0 747 167 | A2 | 12/1999 |
| JP | 55-157473 | | 12/1980 |
| JP | 59-187456 | | 10/1984 |
| JP | 406091522 | | 4/1994 |

OTHER PUBLICATIONS

Abstract for Japanese Publication No. JP 63200965, Aug. 19, 1988.
Abstract for Japanese Publication No. JP 63251166, Oct. 18, 1988.
Abstract for DE 2442081 A., *Two Disc Lapping Machine*, Mar. 18, 1975.
Abstract, Hause, Jr. R. et al.: *Lapping Machine With Soft Carriers*; Jul. 1980.
Copy of co–pending application Ser. No. 09/540,603 filed Mar. 31, 2000.
Copy of claims for co–pending U.S. application Ser. No. 09/672,605 filed Sep. 29, 2000.
Copy of claims for co–pending U.S. application Ser. No. 09/789,346 filed Feb. 20, 2001.
E. Worthington, "New CMP Architecture Addresses Key Process Issues", Solid State Technology, Jan. 1996, pp. 61–62.

*Primary Examiner*—Robert A. Rose
(74) *Attorney, Agent, or Firm*—Brinks Hofer Gilson & Lione

(57) ABSTRACT

A polishing head for performing chemical-mechanical polishing on a linear polisher has a dual stage wafer carrier assembly that incorporates a removable subcarrier. When in use, a main pressure chamber exerts a downforce on the subcarrier housing, while a separate secondary pressure chamber residing between the subcarrier housing and the subcarrier exerts a slightly different downforce on the subcarrier. Since the second pressure chamber exerts the downforce pressure directly on the subcarrier, the direct pressure application, as well as a more uniform distribution of pressure ensures for an improvement to the uniformity of pressure distribution. Additionally, the easily removal subcarrier allows for faster and easier removal of the subcarrier for cleaning and maintenance, as well as for changing inserts and improving process repeatability.

15 Claims, 4 Drawing Sheets

U.S. PATENT DOCUMENTS

| | | | |
|---|---|---|---|
| 3,631,634 | A | 1/1972 | Weber |
| 3,691,694 | A | 9/1972 | Goetz et al. |
| 3,708,921 | A | 1/1973 | Cronkhite et al. |
| 3,731,435 | A | 5/1973 | Boettcher et al. |
| 3,747,282 | A | 7/1973 | Katzke |
| 3,833,230 | A | 9/1974 | Noll |
| 3,886,693 | A | 6/1975 | Tajnafol et al. |
| 3,888,053 | A | 6/1975 | White et al. |
| 3,924,361 | A | 12/1975 | White et al. |
| 3,986,433 | A | 10/1976 | Walsh et al. |
| 4,009,539 | A | 3/1977 | Day |
| 4,020,600 | A | 5/1977 | Day |
| 4,098,031 | A | 7/1978 | Hartman |
| 4,132,037 | A | 1/1979 | Bonora |
| 4,141,180 | A | 2/1979 | Gill, Jr. et al. |
| 4,193,226 | A | 3/1980 | Gill, Jr. et al. |
| 4,194,324 | A | 3/1980 | Bonora et al. |
| 4,256,535 | A | 3/1981 | Banks |
| 4,270,316 | A | 6/1981 | Kramer et al. |
| 4,283,242 | A | 8/1981 | Regler et al. |
| 4,313,284 | A | 2/1982 | Walsh |
| 4,316,757 | A | 2/1982 | Walsh |
| 4,373,991 | A | 2/1983 | Banks |
| 4,450,652 | A | 5/1984 | Walsh |
| 4,459,785 | A | 7/1984 | Zimmer |
| 4,502,252 | A | 3/1985 | Iwabuchi |
| 4,512,113 | A | 4/1985 | Budinger |
| 4,519,168 | A | 5/1985 | Cesna |
| 4,680,893 | A | 7/1987 | Cronkhite et al. |
| 4,693,036 | A | 9/1987 | Toshiyuki Mori |
| 4,711,610 | A | 12/1987 | Riehl |
| 4,753,049 | A | 6/1988 | Toshiyuki Mori |
| 4,811,522 | A | 3/1989 | Gill, Jr. |
| 4,897,966 | A | 2/1990 | Takahashi |
| 4,918,869 | A | 4/1990 | Kitta |
| 4,918,870 | A | 4/1990 | Torbert et al. |
| 4,944,119 | A | 7/1990 | Gill, Jr. et al. |
| 5,035,087 | A | 7/1991 | Nishiguchi et al. |
| 5,036,630 | A | 8/1991 | Kaanta et al. |
| 5,081,795 | A | 1/1992 | Tanaka et al. |
| 5,095,661 | A | 3/1992 | Gill, Jr. et al. |
| 5,121,572 | A | 6/1992 | Hilscher |
| 5,193,316 | A | 3/1993 | Olmstead |
| 5,205,082 | A | 4/1993 | Shendon et al. |
| 5,230,184 | A | 7/1993 | Bukhman |
| 5,238,354 | A | 8/1993 | Volovich |
| 5,257,478 | A | 11/1993 | Hyde et al. |
| 5,297,361 | A | 3/1994 | Baldy et al. |
| 5,329,732 | A | 7/1994 | Karlsrud et al. |
| 5,335,453 | A | 8/1994 | Baldy et al. |
| 5,361,545 | A | 11/1994 | Nakamura |
| 5,377,451 | A | 1/1995 | Leoni et al. |
| 5,398,459 | A | 3/1995 | Okumura et al. |
| 5,404,678 | A | 4/1995 | Hasegawa et al. |
| 5,421,769 | A | 6/1995 | Schultz et al. |
| 5,423,558 | A | 6/1995 | Koeth et al. |
| 5,423,716 | A | 6/1995 | Strasbaugh |
| 5,441,444 | A | 8/1995 | Nakajima |
| 5,443,416 | A | 8/1995 | Volodarsky et al. |
| 5,449,316 | A | 9/1995 | Strasbaugh |
| 5,476,414 | A | 12/1995 | Hirose et al. |
| 5,486,129 | A | 1/1996 | Sandhu et al. |
| 5,507,614 | A | 4/1996 | Leonov et al. |
| 5,527,209 | A | 6/1996 | Volodarsky et al. |
| 5,562,524 | A | 10/1996 | Gill, Jr. |
| 5,567,199 | A | 10/1996 | Huber et al. |
| 5,571,044 | A | 11/1996 | Bolandi et al. |
| 5,575,706 | A | 11/1996 | Tsai et al. |
| 5,575,707 | A | 11/1996 | Talieh et al. |
| 5,582,534 | A | 12/1996 | Shendon et al. |
| 5,584,746 | A | 12/1996 | Tanaka et al. |
| 5,584,751 | A | 12/1996 | Kobayashi et al. |
| 5,593,344 | A | 1/1997 | Weldon et al. |
| 5,607,341 | A | 3/1997 | Leach |
| 5,624,299 | A | 4/1997 | Shendon |
| 5,635,083 | A | 6/1997 | Breivogel et al. |
| 5,681,215 | A | 10/1997 | Sherwood et al. |
| 5,692,947 | A | 12/1997 | Talieh et al. |
| 5,716,258 | A | 2/1998 | Metcalf |
| 5,762,544 | A | 6/1998 | Zuniga et al. |
| 5,803,799 | A | 9/1998 | Volodarsky et al. |
| 5,857,899 | A | 1/1999 | Volodarsky et al. |
| 5,951,373 | A | 9/1999 | Shendon et al. |
| 5,993,302 | A | 11/1999 | Chen et al. |
| 6,024,630 | A | 2/2000 | Shendon et al. |
| 6,089,961 | A | 7/2000 | Cesna et al. |
| 6,206,768 | B1 | 3/2001 | Quek |

POLISHING HEAD WITH REMOVABLE SUBCARRIER

This is a division of Ser. No. 08/838,381, filed Apr. 8, 1997, now U.S. Pat. No. 6,244,946.

BACKGROUND OF THE INVENTION

1. Field of the Invention

The present invention relates to the field of semiconductor wafer processing and, more particularly, to polishing heads for use in the chemical-mechanical polishing of semiconductor wafers.

2. Background of the Related Art

The manufacture of an integrated circuit device requires the formation of various layers (both conductive and non-conductive) above a base substrate to form the necessary components and interconnects. During the manufacturing process, removal of a certain layer or portions of a layer must be achieved in order to pattern and form various components and interconnects. Chemical mechanical polishing (CMP) is being extensively pursued to planarize a surface of a semiconductor wafer, such as a silicon wafer, at various stages of integrated circuit processing. It is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer in combination with the chemical reaction of the slurry disposed between the wafer and the pad, provide the abrasive force with chemical erosion to polish the exposed surface of the wafer (or a layer formed on the wafer), when subjected to a force pressing the wafer onto the pad. In the most common method of performing CMP, a substrate is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head. Rotation of the polishing head helps in the slurry delivery as well in averaging the polishing rates across the substrate surface.

Another technique for performing CMP to obtain a more uniform polishing rate is the use of a linear polisher. Instead of a rotating platen and pad, a moving belt is used to linearly move the pad across the wafer surface. The wafer is still rotated for averaging out the local variations, but the global planarity is improved over CMP tools using rotating pads. One such example of a linear polisher is described in a patent application titled "Control Of Chemical-Mechanical Polishing Rate Across A Substrate Surface For A Linear Polisher," Ser. No. 08/638,462, filed Apr. 26, 1996, which is also related to a patent application titled "Control Of Chemical-Mechanical Polishing Rate Across A Substrate Surface;" Ser. No. 08/638,464; filed Apr. 26, 1996.

Unlike the hardened table top of a rotating polisher, linear polishers are capable of using flexible belts, upon which the pad is disposed. This flexibility allows the belt to flex, which can cause a change in the pad pressure being exerted on the wafer. When this flexibility can be controlled, it provides a mechanism for controlling the polishing rate and/or the profile. Accordingly, a fluid platen can be readily utilized to control the pad pressure being exerted on a wafer at various locations along the wafer surface. Examples of fluid platens are disclosed in the afore-mentioned related applications and in U.S. Pat. No. 5,558,568.

With either type of polisher (linear or rotary), the polishing head is an important component of the polishing tool. The polishing head provides means for holding and supporting the wafer, rotating the wafer and transmitting the polishing force to engage the wafer against the pad. Generally, the polishing head includes a housing in which a wafer carrier resides. The wafer carrier and/or the head housing is coupled to a rotating mechanism so that the wafer can rotate. In some systems, the carrier or the housing is gimbaled. In other systems, the gimballing action is not desirable, so that a restrictive mechanism is used to prevent the gimballing action from occurring.

The wafer is mounted on the carrier and held in place by a retainer element, such as a wafer retaining ring. A thin seating material (insert) may be utilized on the mounting surface of the carrier to cushion the seating of the wafer. When in operation, the carrier may have one or more height positions. For example, one height position relative to the housing can be for the mounting of the wafer onto the carrier assembly, while a second height position of the carrier is used when the wafer is to engage the polishing pad.

Generally, when the wafer is being polished, the downforce exerted by the polishing head assembly should be of sufficient magnitude to press the wafer onto the pad so that CMP can be performed. When linear polishers are utilized, they generally employ a flexible belt/pad assembly, so that a fluid platen can exploit this flexible property. The fluid flow from the fluid platen can compensate (or adjust) the pressure exerted by the polishing pad in engaging the wafer.

Likewise, this flexibility can be incorporated in a polishing head as well. By using a flexible diaphragm (or membrane) to couple the carrier to the head housing, the wafer carrier can be made to flex. One such polishing head utilizing a flexible diaphragm in a polishing head for a rotating table polisher is disclosed in a U.S. Pat. No. 5,205,082. By ensuring a steady positive pressure on the carrier, a steady downforce can be maintained to provide for the head to press the wafer onto the pad. The polishing head of the present invention provides for an improvement in distributing the downforce exerted on the wafer, which improves the manner in which the wafer engages the linearly moving polishing pad.

A problem with prior art polishing heads is that the wafer carrier is quickly contaminated (dirtied) by the dispensed slurry and the polished waste material. The cleaning of the head assembly is difficult and can be time consuming. The polishing equipment is taken "off-line" while it is being cleaned. Shortening the down-time of the equipment will allow the equipment to be in service for a longer period and thereby improving the manufacturing cycle for processing the wafers.

The present invention describes a novel polishing head in which the wafer engagement is improved and also in which cleaning is made easier due to the removable nature of the carrier assembly. The removable subcarrier of the present invention also allows for an easier insert replacement and improved polishing process repeatability.

SUMMARY OF THE INVENTION

The present invention describes a polishing head for performing chemical-mechanical polishing on a linear polisher, in which a dual stage wafer carrier assembly is utilized to improve the distribution of the downforce pressure being exerted on the wafer. The first stage of the wafer carrier assembly is comprised of a subcarrier housing which is attached to the main body of the head housing by a flexible diaphragm. The second stage is comprised of a removable subcarrier, which is not fixedly attached to the subcarrier housing.

When in use, a main pressure chamber exerts a downforce on the subcarrier housing, while a separate secondary pressure chamber residing between the subcarrier housing and the subcarrier is also under positive pressure. Since the second pressure chamber exerts pressure directly on the subcarrier and since this pressure is distributed more uniformly on the subcarrier, the downforce on the wafer is also more uniformly distributed as well. The more uniformly distributed downforce ensures a more uniform polishing when the wafer engages the polishing pad.

Additionally, the easily removal subcarrier allows for faster and easier cleaning and maintenance, as well as for replacing an insert which is used for seating the wafer. Also, since only the subcarrier needs to be removed, instead of the complete carrier or even the head assembly, less weight needs to be handled during routine cleaning procedures. Furthermore, since only the subcarrier needs to be replaced, instead of the complete head assembly, for some of the routine maintenance, polishing process repeatability is improved as well.

DETAILED DESCRIPTION OF THE PREFERRED EMBODIMENTS

A novel polishing head to perform chemical-mechanical polishing (CMP) on a substrate is described. In the following description, numerous specific details are set forth, such as specific structures, materials, polishing techniques, etc., in order to provide a thorough understanding of the present invention. However, it will be appreciated by one skilled in the art that the present invention may be practiced without these specific details. In other instances, well known techniques and structures have not been described in detail in order not to obscure the present invention. It is to be noted that a preferred embodiment of the present invention is described in reference to a linear polisher. However, it is readily understood that other types of polishers (including rotating table polishers) can be designed and implemented to practice the present invention without departing from the spirit and scope of the invention. Furthermore, although the present invention is described in reference to performing CMP on a semiconductor wafer, the invention can be readily adapted to polish other materials as well, including substrates for manufacturing flat panel displays.

Figure 1:
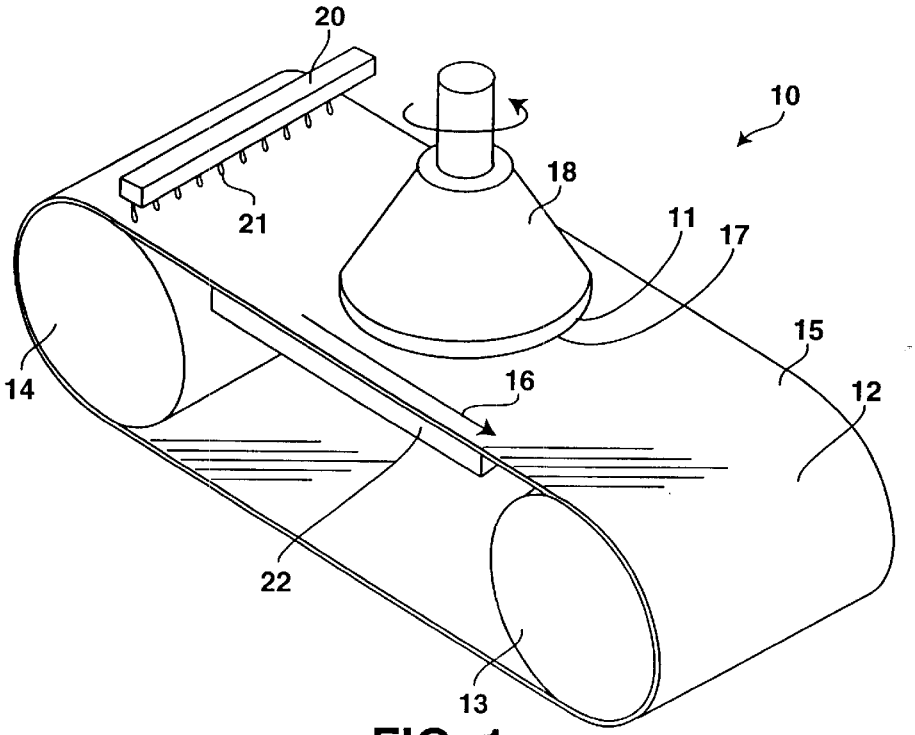
FIG. 1 Prior Art
FIG. 1 is a pictorial illustration of a prior art linear polisher for performing CMP.
Figure 2:
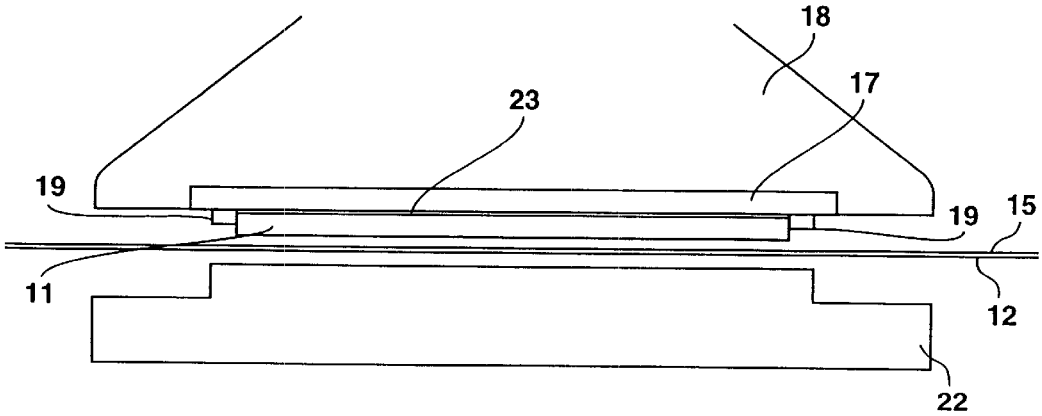
FIG. 2 Prior Art
FIG. 2 is a cross-sectional diagram of a portion of the linear polisher of FIG. 1.

Referring to FIG. 1, a linear polisher 10 for use in practicing the present invention is shown. FIG. 2 shows a cross-section of a portion of the polisher 10. The linear polisher 10 is utilized in polishing a semiconductor wafer 11, such as a silicon wafer, to polish away materials on the surface of the wafer. The material being removed can be the substrate material of the wafer itself or one of the layers formed on the substrate. Such formed layers include dielectric materials (such as silicon dioxide), metals (such as aluminum, copper or tungsten) and alloys, or semiconductor materials (such as silicon or polysilicon). More specifically, a polishing technique generally known in the art as chemical-mechanical polishing (CMP) is employed to polish one or more of these layers fabricated on the wafer 11, in order to planarize the surface. Generally, the art of performing CMP to polish away layers on a wafer is known and prevalent practice has been to perform CMP by subjecting the surface of the wafer to a rotating platform (or platen) containing a pad.

The linear polisher 10 utilizes a belt 12, which moves linearly in respect to the surface of the wafer 11. The belt 12 is a continuous belt rotating about rollers (or spindles) 13 and 14, in which one roller or both is/are driven by a driving means, such as a motor, so that the rotational motion of the rollers 13–14 causes the belt 12 to be driven in a linear motion (as shown by arrow 16) with respect to the wafer 11. A polishing pad 15 is affixed onto the belt 12 at its outer surface facing the wafer 11. Thus, the belt/pad assembly is made to move linearly to polish the wafer 11.

The wafer 11 typically resides on a wafer carrier 17, which is part of a polishing head assembly 18. The wafer 11 is held in position by a mechanical retaining means, such as a retainer ring 19, to prevent horizontal movement of the wafer when the wafer 11 is positioned to engage the pad 15. Generally, the head assembly 18 containing the wafer 11 is rotated, while the belt/pad moves in a linear direction 16 to polish the wafer 11. The linear polisher 10 also includes a slurry dispensing mechanism 20, which dispenses a slurry 21 onto the pad 15. A pad conditioner (not shown in the drawings) is typically used in order to recondition the pad 15 during use. Techniques for reconditioning the pad 15 during use are known in the art and generally require a constant scratching of the pad in order to remove the residue build-up caused by the used slurry and removed waste material.

A support or platen 22 is disposed on the underside of the belt 12 and opposite from carrier 17, such that the belt/pad assembly resides between the platen 22 and wafer 11 (which illustration is more clearly shown in FIG. 2). A primary purpose of the platen 22 is to provide a supporting platform on the underside of the belt 12 to ensure that the pad 15 makes sufficient contact with wafer 11 for uniform polishing. Typically, the carrier 17 is pressed downward against the belt 12 and pad 15 with appropriate force, so that the pad 15 makes sufficient contact with the wafer 11 for performing CMP. Since the belt 12 is flexible and will depress when the wafer is pressed downward onto the pad 15, the platen 22 provides a necessary counteracting support to this downward force (also referred to as downforce).

The platen 22 can be a solid platform or it can be a fluid platen (also referred to as a fluid bearing). The preference is to have a fluid platen, so that the fluid flow from the platen can be used to adjust forces exerted on the underside of the belt 12. By such fluid flow control, pressure variations exerted by the pad on the wafer can be adjusted to provide a more uniform polishing rate of the wafer surface. Examples of fluid platens are disclosed in the aforementioned patent applications and in U.S. Pat. No. 5,558,568.

Whether a solid platen or a fluid platen is used, the polishing head assembly 18 is a necessary element of the polisher 10. The head 18 includes the carrier 17, which is needed to hold and rotate the wafer 11. The wafer 11 rests on a seating pad or insert 23 and once positioned onto the carrier, the wafer 11 is held in position by the retainer ring 19 to prevent horizontal (sideways) movement. Some amount of downforce pressure is required to press the wafer 11 down onto the polishing pad 15. The same applies to both (linear and rotating) types of polishers and the amount of the downforce will depend on the particular polisher.

One type of carrier design employs a diaphragm (or membrane) to couple the carrier 17 to a housing body of the polishing head assembly 18. The flexible diaphragm permits the carrier to flex in the vertical direction, so that the carrier 17 and wafer 11 can move relative to the main body of the polishing head 18. Positive air pressure is introduced into the open area (cavity or chamber) above the carrier 17 so that the carrier is forced to engage the polishing pad 15 with adequate downforce.

Due to the flexibility of the diaphragm, polishing heads employing the diaphragm coupled wafer carrier are desirable for polishing wafers (as well as other materials or substrates) on a linear polisher. Accordingly, the present invention describes a novel polishing head, which provides for a two stage wafer carrier where one of the stages is made easily removable from the polishing head assembly. A dual pressure chamber is also utilized to exert different fluid pressures to the two stages of the wafer carrier, which then allows for a more direct distribution of the downforce pressure to be exerted on the wafer itself.

Figure 3:
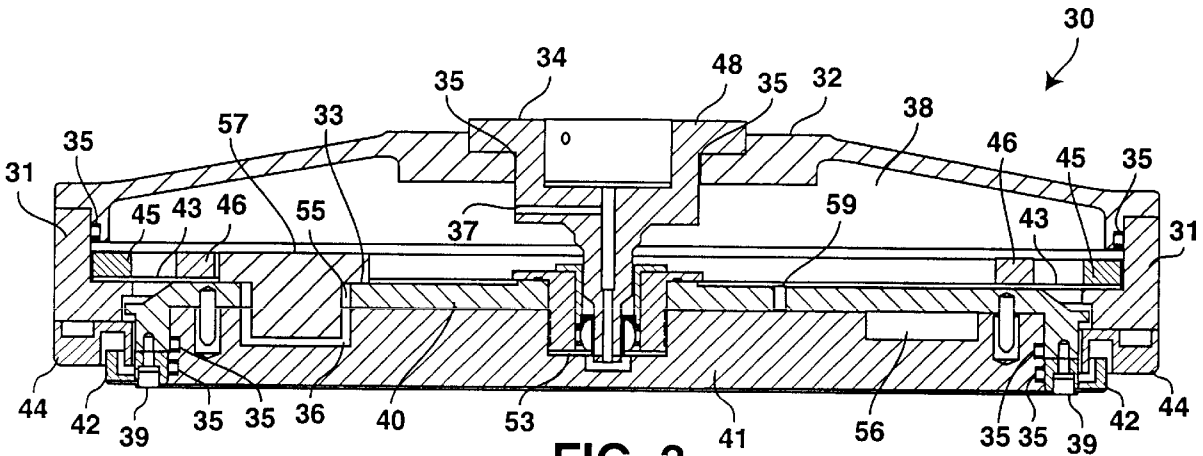
FIG. 3 is a cross-sectional view of a polishing head of the preferred embodiment taken across axis line 3—3 in FIG. 5.
Figure 4:
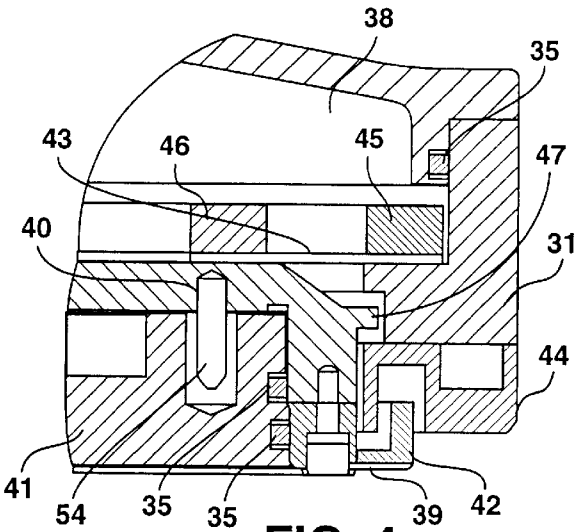
FIG. 4 is an enlarged cross-sectional view of a peripheral portion of the polishing head of FIG. 3.
Figure 5:
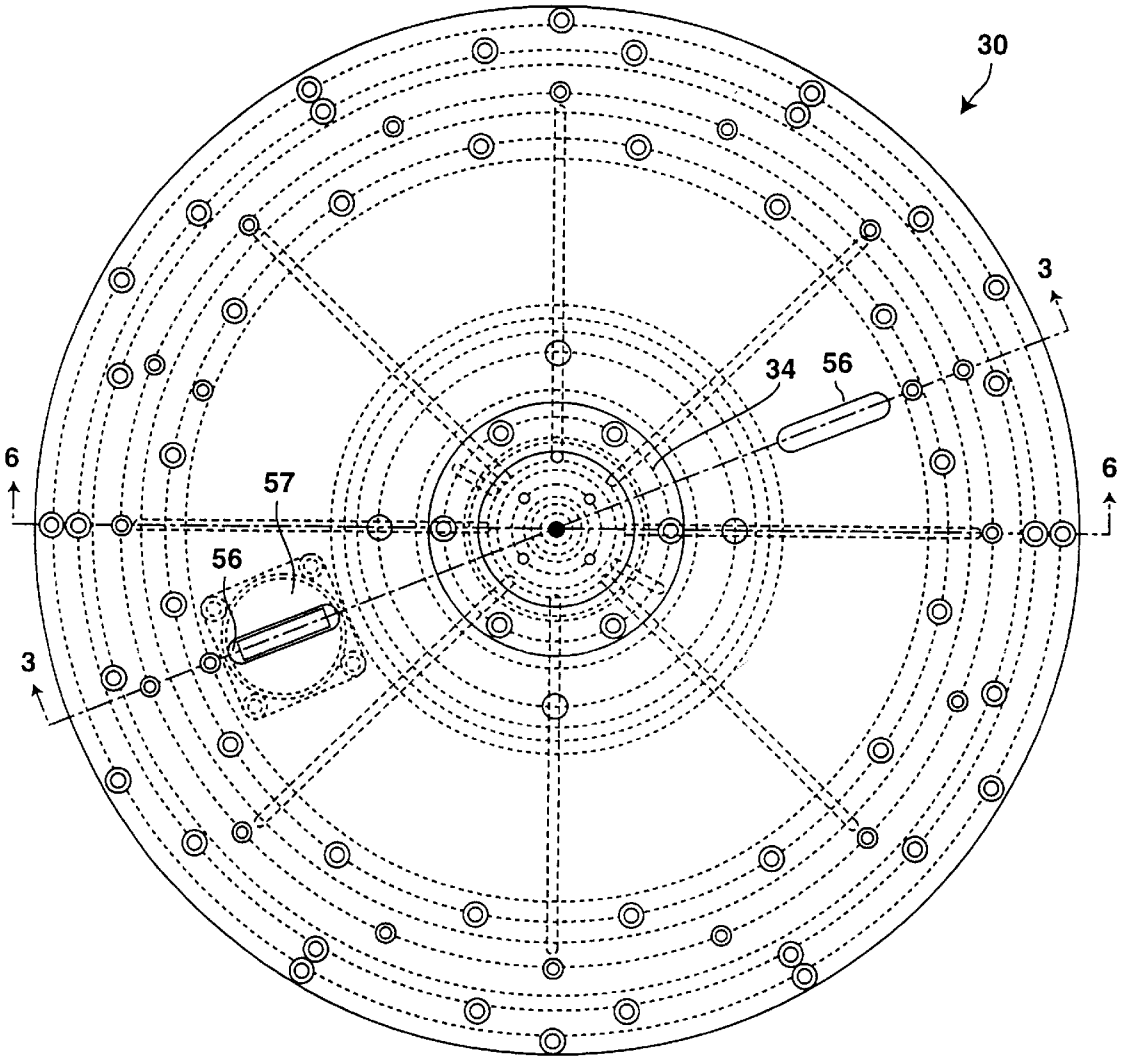
FIG. 5 is a top cross-sectional view of the polishing head of the present invention in which the two axes, 3—3 and 6—6, shown in the Figure correspond to the cross-sections of the polishing head shown in FIGS. 3 and 6, respectively.
Figure 6:
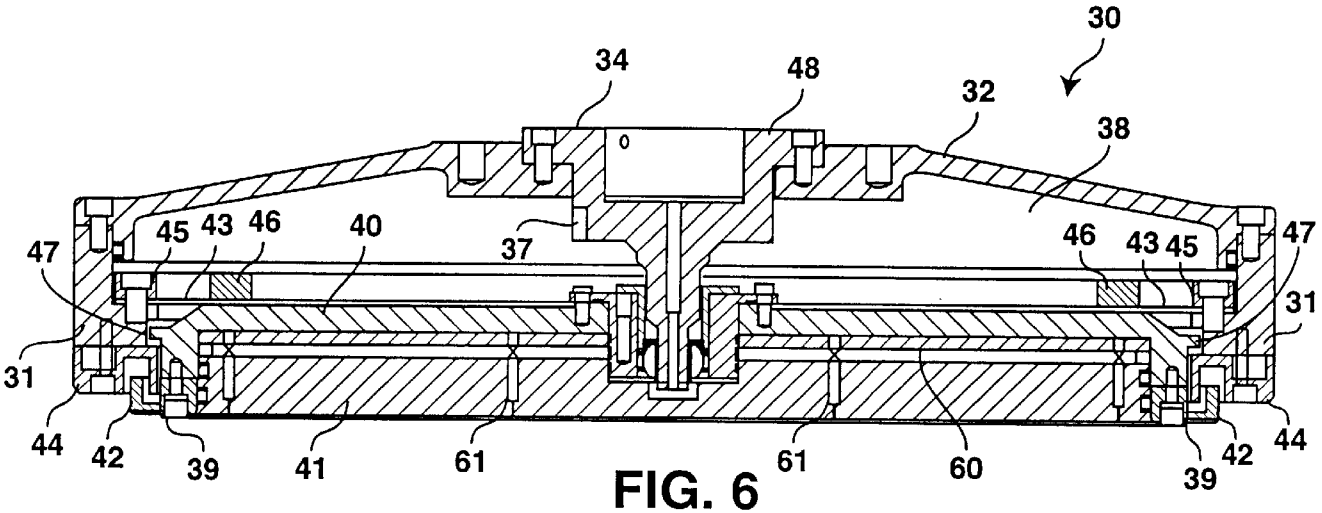
FIG. 6 is another cross-sectional view of a polishing head of the preferred embodiment taken across axis line 6—6 in FIG. 5.
Figure 7:
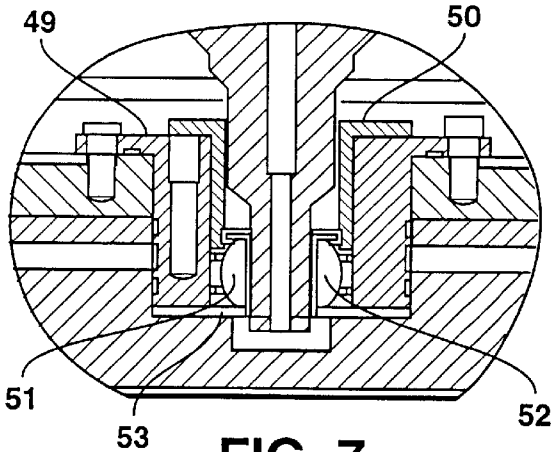
FIG. 7 is an enlarged cross-sectional view of a center portion of the polishing head as shown in FIG. 6.

In FIG. 3, a cross-sectional view of a polishing head 30 of the preferred embodiment is shown. When employed with a linear polisher (such as the linear polisher 10 of FIG. 1), the polishing head 30 is utilized in place of the polishing head 18. A second cross-sectional view of the polishing head 30, taken across another axis, is shown in FIG. 6. The two axes for the two cross-sectional views are noted in the top view of the head, which is shown in FIG. 5. Accordingly, the description below should be read in reference to FIGS. 3, 5 and 6, as well as the enlarged views shown in FIGS. 4 and 7.

The polishing head 30 is comprised of a head housing (also referred to as a support housing) 31, cover 32, carrier assembly 33 and center flange assembly 34. Unlike the prior art wafer carriers, the carrier assembly 33 is comprised of two separate stages, identified as a carrier housing (also referred to as a subcarrier housing, since it is coupled to house a subcarrier) 40 and a removable subcarrier 41. The head or support housing 31 is circular in shape and forms the outer support body for the polishing head 30. The cover 32 has a central opening into which the flange assembly 34 is inserted. The cover 32 is affixed to the upper end of the housing 31 to enclose the interior center region of the housing 31, when the flange assembly 34 is also in place.

At the opposite end from the cover 32, the head housing 31 forms a circular opening into which the carrier assembly 33 is disposed. The subcarrier housing 40 is coupled to the head housing 31 by a flexible coupling means, such as a diaphragm (or flexible membrane) 43. As shown in FIGS. 3 and 6, and in more detail in FIG. 4, the diaphragm 43 is stretched across and mounted onto a base surface of the housing 31 and an upper surface of the subcarrier housing 40. In the preferred embodiment, two circular retaining rings 45 and 46 are utilized, one at each end of the diaphragm 43 to retain it in place across the two housings. The retaining rings are affixed tightly onto the two housings by a mounting means, such as screws or bolts. With the placement of the subcarrier housing 40 into position when coupled to the head housing 31, the two housings 31 and 40, diaphragm 43, cover 32, and flange assembly 34 form an enclosed region referenced as a main pressure chamber 38.

When in operation, pressurized fluid (preferably air or gas) is then introduced into the main chamber 38 through a port opening 37 of a fluid line in the flange assembly 34, so that the pressure in the chamber 38 can be adjusted. Positive pressure in the chamber 38 ensures that a steady downward pressure is exerted when the wafer 11 engages the belt/pad assembly. By having the chamber 38 at a higher pressure than the ambient (the pressure outside of the polishing head), the carrier assembly 33 can be forced downward against the pad during polishing and in which, the amount of the downforce can be adjusted by varying the pressure in the main chamber 38. It is also appreciated that during polishing, an upward force from the belt region can cause the carrier assembly 33 to be pushed upward with some amount of force. The pressure in the main chamber 38 ensures that a steady downforce is exerted to engage the wafer on the pad, even when this upward (or counter-acting) force is present.

As described above, the carrier assembly 33 is comprised of the subcarrier housing 40 and the subcarrier 41. The subcarrier housing 40 forms the floor of the main chamber 38. The peripheral sides of the subcarrier housing 40 aligns to the interior side of the head housing 31, but a slight gap exists between the two surfaces, which allows the subcarrier housing 40 to move vertically relative to the head housing 31 as the diaphragm 43 flexes. That is, the two housing surfaces are coupled together by the diaphragm 43 and move vertically relative to each other.

At the lower end of the subcarrier housing 40, a retainer ring 39 is affixed to the subcarrier housing 40 to prevent horizontal movement of the wafer, when the wafer is positioned in place. The retainer ring 39 has an L-shaped projection 42 which projects outwardly, then upwardly from the subcarrier housing 40. The upward bend of the projection 42 enters a recessed opening of a lower flange 44, located at the lower surface of the head housing 31. Also, as shown in the drawings at various locations, a number of O-rings 35 are distributed throughout the head 30 to provide a seal where various components of the head mate. The O-rings 35 also ensure to provide a pressure seal for the main chamber 38, as well as for a secondary chamber described below.

In order to rotate the head 30, as well as providing fluid and/or vacuum feed lines, the flange assembly 34 is inserted through a central opening in the cover 32 and the subcarrier housing 40, and the distal end of the flange assembly 34 extends through the central opening of the subcarrier housing 40. As shown in FIGS. 3 and 6, and in more detail in FIG. 7, the flange assembly 34 is comprised of a flange shaft 48, which has a wider diameter at the cover end versus a narrower diameter at the distal (or subcarrier) end. The upper end of the flange shaft 48 is affixed to the cover 32, while the distal end is made to fit into a bearing housing 49. When the head 30 is assembled, it is coupled to a spindle (not shown) for rotating the head. The shaft of the spindle has an adapter (not shown) which fits into the central opening area at the upper end of the flange shaft 48. The spindle adapter is affixed (by bolts or screws) to the cover 32, so that when the spindle is driven, it causes the head 30 to rotate. The various feed lines, such as fluid and vacuum lines, are coupled to the head 30 through the spindle and the flange assembly 34.

The flange assembly 34 includes a number of components at the subcarrier end to ensure that the flange shaft 48 fits properly into the central open region of the subcarrier housing 40. As shown in detail in FIG. 7, the bearing housing 49 is disposed within the central opening of the subcarrier housing 40 and affixed to it by mounting means (such as bolts and screws). A clamp bearing 50 is disposed within the bearing housing 49 to ensure a snug fit of the flange shaft 48. A spherical bearing 51 and a linear slide bearing 52 are disposed at the tip region of the flange shaft 48 as well. The slide bearing 52 allows vertical movement of the carrier assembly 33 relative to the flange shaft 48. The spherical bearing 51 allows some degree of angular (rotational) freedom for the lower subcarrier 41. As shown in the Figures, the slide bearing 52 is press fitted into the spherical bearing 51 and the spherical bearing 51 is clamped in place by the clamp bearing 50.

Thus, as the spindle is driven, the cover 32 is made to rotate, causing the complete head assembly 30 to rotate. Due to the flexible coupling of the diaphragm 43, the subcarrier housing 40 is capable of moving in the vertical direction, However, the vertical travel of the subcarrier housing 40 relative to the head housing 31 is limited by the presence of ridged mechanical stops. The L-shaped projection 42 provides for a limit in the upward vertical travel of the subcarrier housing 40 and ringed extension 47 of the subcarrier housing 40 provides for a limit in the downward travel direction.

An improved feature of the head 30 of the present invention is the use of a subcarrier 41, which is removable. As shown in the Figures, the subcarrier 41 is a separate element from the subcarrier housing 40. The subcarrier 41 is made to fit onto the subcarrier housing 40 and within the circular boundary of the head housing 31. The lower surface of the subcarrier 41 is substantially flat so that the wafer 11 can be mounted thereon. Two guide pins 54, located on the subcarrier housing 40, assist in positioning the subcarrier 41 for coupling it to the subcarrier housing 40. That is, the guide pins 54 are used to guide the two units 40 and 41 as they are being mated together. The subcarrier 41 has a central recessed region 53 for receiving the flange assembly 34, including the distal end of the flange shaft 48. The alignment of the two units 40 and 41 is achieved by having the bearing housing 49 fully seated in the recess 53.

At this point, the subcarrier 41 is positioned against the subcarrier housing 40 and is restricted or limited in its movement in the vertical and horizontal directions. However, final alignment of the subcarrier 41 to the subcarrier housing 40 is achieved when a flange key is inserted as noted below. At least one recessed slot 56 (two are shown in the Figures), located proximal to the outer edge, is needed to couple a flange key 57, which operates as a torque transfer coupler. The key 57 is used to transfer torque from the subcarrier housing 40 to the subcarrier 41. The key 57 is inserted through a key opening 55 in the subcarrier housing 40 and made to extend into one of the mating slots 56 on the subcarrier 41. The key is mounted onto the subcarrier housing 40 by screws, bolts or other mounting means. A purpose of the flange key 57 is to transfer the torque from the driven subcarrier housing 40 to the subcarrier 41, so that the subcarrier 41 will rotate when the head 30 is driven. It is appreciated that other torque transfer couplers can be used in place of the flange key 57 to transfer the torque.

When the subcarrier 41 is inserted in position onto the subcarrier housing 40, the opening 55 mates to one of the slots 56 containing the key 57. However, even though the two units 40 and 41 are aligned into position, the subcarrier 41 is not affixed onto the subcarrier housing 40 by mounting means, such as bolts or screws. The subcarrier 41 is made removable or detachable from the subcarrier housing 40 and the head assembly 30.

The preferred technique is to utilize vacuum to hold the two units 40 and 41 together. That is, vacuum feed to the carrier housing surface which mates to the subcarrier 41, ensures that the subcarrier 41 will not separate from the subcarrier housing 40. As a further assurance, in the preferred embodiment, O-rings 35 disposed around the periphery of the subcarrier 41, provide for a friction fit between the two units 40 and 41. Since at least one O-ring (or an equivalent sealing device) is needed for sealing a pressure chamber, the presence of the O-ring(s) will also provide a friction fit of the two units 40 and 41. This friction fit will retain the subcarrier 41 against the subcarrier housing 40 once installed. Thus, if the head assembly 30 is lifted, the subcarrier 41 will not drop out of the head assembly 30, even if the vacuum is removed. However, the preferred technique is to have the vacuum present.

When the subcarrier 41 is in position, a secondary pressure chamber 60 forms between the lower surface of the subcarrier housing 40 and the upper surface of the subcarrier 41. One or more O-ring(s) 35 along the side of the subcarrier 41 ensure a tight fit between the subcarrier 41 and the subcarrier housing 40 along the vertical interface in order to form a tight seal for the chamber 60. A separate fluid line having a port opening 59 is coupled to the secondary chamber 60 to introduce pressurized fluid (preferably air or gas) between the subcarrier housing 40 and the subcarrier 41. A purpose of this secondary pressure chamber 60 will be described below.

Additionally, a third fluid line is used to couple vacuum to and through the subcarrier 41. A plurality of channels 61 formed through the subcarrier 41 couple the vacuum line from the subcarrier housing 40 to openings formed at the wafer receiving surface of the subcarrier 41. The channels 61 convey vacuum pressure to the wafer receiving surface of the subcarrier 41, so that once the wafer is placed on this surface, the vacuum will retain the wafer thereon. In an alternative embodiment, channels 61 (or a separate equivalent line) has fluid (liquid in the preferred embodiment) flow as well to dislodge the wafer from the surface of the subcarrier 41. In the preferred embodiment, vacuum is coupled to the channels 61 to hold the wafer against the subcarrier 41 and later, water is coupled to the channels 61 so that water flow is used to safely break the adhesive bond between the wafer and the subcarrier 41.

In operation, when the polishing head 30 of the present invention is to be utilized for performing CMP on a substrate material, such as a silicon semiconductor wafer, the head assembly is brought into position above the belt assembly, minus the subcarrier 41. The subcarrier 41 is aligned to the key 57 to position the subcarrier 41 within the head assembly. At this point, the subcarrier 41 is friction fitted and installed onto the subcarrier housing 40. Once installed, the subcarrier 41 is safely maintained in its position by the use of vacuum.

The preferred technique is to couple the second fluid line to vacuum (or near vacuum pressure) so that a pressure less than ambient (negative pressure) is present at the port opening 59. This negative pressure is introduced into the secondary chamber 60, in order to ensure that the subcarrier 41 is maintained in the up (or installed) position relative to the subcarrier housing 40. It is appreciated that other retaining techniques can be used as well to hold the subcarrier 41 in position against the subcarrier housing 40, but the preferred technique is to use vacuum. It is to be noted that the O-rings friction fit the subcarrier 41 to retain it in place against the subcarrier housing 40. However, it is more desirable to apply the vacuum, in order to ensure that the subcarrier 41 will stay in the installed position. It is also appreciated that in some alternative designs, there may be frictionless fit between the subcarrier 41 and the subcarrier housing 40. In that instance, the application of vacuum will ensure that the two units will be held together.

Subsequently, the wafer is loaded onto the subcarrier 41. The preferred technique couples vacuum to the channels 61, so that this vacuum will retain the wafer against the subcarrier surface. The retainer ring 39 ensures that the wafer will not slip in the horizontal direction. It is also preferred at this stage to have the main chamber 38 under some positive pressure, so that the subcarrier housing 40 is forced downward, making the subcarrier 41 insertion easier. Once the subcarrier 41 is loaded onto the subcarrier housing 40 and the wafer is loaded onto the subcarrier 41, the head 30 is lowered to engage the polishing belt to perform CMP.

Once the head has engaged the pad, positive pressure is increased in the main chamber 38. The increased positive pressure in the main chamber 38 ensures that adequate downforce is exerted to keep the wafer pressed onto the pad. At this point, vacuum for holding the wafer is removed. Since the wafer is now pressed onto the pad, vacuum is not needed. The main chamber 38 should be at the operating pressure. If not, then the main chamber pressure is brought to its operating pressure.

At this point, the subcarrier 41 rests against the subcarrier housing 40. Then, the vacuum is removed from the secondary chamber 60 and the pressure to the secondary chamber 60 is raised up to its operating pressure. Typically, the pressure in the secondary chamber 60 is maintained slightly lower than the pressure in the main chamber 38. For example, if the main chamber 38 has an operating pressure set at 5 p.s.i., then the secondary chamber 60 is maintained at a pressure of approximately 4.5 p.s.i. This ensures that there is slightly more downforce exerted on the subcarrier housing 40, so that the subcarrier 41 will not separate from the subcarrier housing 40.

Since there is a separate pressure chamber residing directly above the subcarrier 41, this secondary chamber 60 ensures a direct distribution of the pressure onto the subcarrier itself. Also, since the fluid to the secondary chamber 60 is independently controlled from the fluid flow into the main chamber 38, variations in the pressure (or variations in the pressure distribution) of the main chamber will have less of an effect on the downforce exerted on the wafer. By having this separate pressure chamber 60, a more confining region between the subcarrier housing 40 and the subcarrier 41 is defined for the distribution of the final pressure stage for exerting the downforce. Thus, a more uniform downforce can be exerted in pressing the wafer onto the pad surface. That is, the downforce exerted onto the wafer is distributed directly and more uniformly, than if that force were applied only within the main chamber 38. Thus, a more uniform polishing of the wafer can be achieved, due to a more uniform and direct pressure distribution on the subcarrier 41.

As stated earlier, during the polishing process, vacuum is not present in the third fluid line. As the head 30 is rotated, the subcarrier 40 rotates with the head assembly. The key 57 couples the rotating motion of the subcarrier housing 40 to the subcarrier 41 in order to rotate the subcarrier 41. Thus, the torque transfer is achieved by the key 57.

Subsequently, once the polishing is completed, the secondary chamber 60 pressure is lowered and vacuum is introduced to hold the subcarrier 41 against the subcarrier housing 40. Vacuum is also introduced in the channels 61 to hold the wafer against the subcarrier 41, so as to ensure a secure hold on the wafer when the head 30 is lifted from the belt/pad assembly. The pressure in the main chamber 38 is lowered and the head assembly is lifted from the pad. Fluid (in the form of water for the preferred embodiment) is introduced into the channels 61 to gently break the bond between the wafer and the lower surface of the subcarrier 41. Subsequently, the next wafer for polishing is loaded into the subcarrier 41.

Aside from the advantages noted above, the present invention also has further advantages, as noted below. Since the subcarrier 41 is not attached as part of the carrier or subcarrier housing 40, it can be readily removed. Furthermore, since only the subcarrier 41 is removed (and not the complete head assembly) the weight of the assembly being handled during removal is significantly lighter, making the removal process much easier. Additionally, since the subcarrier 41 can be easily removed, it can be cleaned more rapidly and the wafer insert or pad material (which resides between the wafer and the subcarrier 41) can be replaced more easily as well.

Another advantage is in the area of process or manufacturing repeatability. Repeatability, as defined, is the ability to obtain the same parameters (or results), each time a process is performed on a tool. Thus, with prior art polishing heads, the complete head assembly is removed to service the wafer carrier for many routine maintenance procedures. In some instances disassembly is required. When the polishing head is then placed back in service, it may not retain the same performance characteristics, which then will require adjustments to repeat the desired performance. Although there may be instances where a complete head removal may be necessary with the present invention, a number of routine maintenance procedures will only require the subcarrier to be removed. Removing only the subcarrier will reduce (or eliminate) the need for adjustments when the subcarrier is placed back into service. Accordingly, having the removable subcarrier improves the repeatability of the polishing head and the tool to which it is mounted on.

Thus, by employing a wafer carrier having two stages, a more uniform and direct downforce can be applied to engage the wafer onto the pad. Furthermore, by making the second stage removable, the portion of the carrier for mounting the wafer can be cleaned and/or replaced with much ease. Process repeatability is also enhanced. Thus, a polishing head with a removable subcarrier is described. It is also appreciated that although the polishing head of the preferred embodiment is described in reference to a head utilized on a linear polisher, the present invention can be readily adapted for use on rotating table polishers as well.

I claim:

1. A method of polishing a surface of a semiconductor wafer by engaging said wafer surface against a polishing pad, comprising the steps of:

providing a polishing head to mount said wafer thereon, said polishing head having a two-stage wafer carrier in which a first stage is comprised of a carrier housing fixedly mounted on said polishing head;

inserting a second stage of said polishing head, which is comprised of a removable subcarrier, into said carrier housing wherein said subcarrier is installed against said carrier housing;

placing said wafer onto said subcarrier;

rotating said polishing head by rotating said carrier housing such that a flange key attached to the carrier housing contacts a recessed mating slot defined by an upper surface of the subcarrier to transfer torque to said subcarrier for rotating said subcarrier; and polishing said wafer surface by engaging said wafer to said pad.

2. The method of claim 1 further including the step of introducing a first positive pressure to a region above said carrier housing and a second positive pressure between said carrier housing and said subcarrier for a direct application of downforce pressure to polish said wafer.

3. The method of claim 2 further including the step of providing a flexible diaphragm for mounting said first stage to a support housing of said polishing head.

4. The method of claim 3 further including a step of providing vacuum to said carrier housing to retain said subcarrier against it by vacuum when inserting said second stage.

5. A method of polishing a surface of a semiconductor wafer by engaging a surface of the wafer against a polishing pad, the method comprising:

providing a polishing head having a carrier housing coupled to a support housing, a cover coupled to the support housing and forming a first pressure chamber in an area above said carrier housing, and a removable wafer subcarrier configured to retain a semiconductor wafer, wherein a second chamber is defined by said carrier housing and said subcarrier;

providing a first pressure in the first chamber; and providing a second pressure in the second chamber, wherein providing the second pressure in the second chamber comprises distributing the second pressure directly onto the subcarrier for downward exertion of the wafer against the polishing pad.

6. The method of claim 2, wherein the second pressure is less than the first pressure.

7. The method of claim 5, wherein the second pressure is less than the first pressure.

8. The method of claim 1, further comprising retaining the wafer to the subcarrier with a negative pressure provided through at least one channel in the subcarrier.

9. The method of claim 5, further comprising retaining the wafer to the subcarrier with a negative pressure provided through at least one channel in the subcarrier.

10. A method of polishing a surface of a semiconductor wafer by engaging a surface of the wafer against a polishing pad, the method comprising:

providing a polishing head having a carrier housing coupled to a support housing, a cover coupled to the support housing and forming a first pressure chamber within the polishing head in an area above the carrier housing, and a removable wafer subcarrier configured to retain a semiconductor wafer, wherein a second chamber is defined by the carrier housing and said subcarrier;

frictionally retaining the subcarrier in the polishing head prior to pressing the wafer against the polishing pad;

pressing the wafer against the polishing pad;

maintaining a first positive pressure in the first chamber; and maintaining a second positive pressure in the second chamber, wherein the second positive pressure in the second chamber distributes a downforce directly on the subcarrier for downward exertion of the wafer against the polishing pad.

11. The method of claim 10, further comprising introducing a vacuum in the second chamber prior to pressing the wafer against the polishing pad whereby the subcarrier is retained in the polishing head by at least one of a friction force and the vacuum.

12. The method of claim 10, wherein the second positive pressure is less than the first positive pressure.

13. The method of claim 10, further comprising retaining the wafer to the subcarrier with a negative pressure provided through at least one channel in the subcarrier.

14. The method of claim 13, further comprising removing the wafer from the subcarrier with a fluid provided through the at least one channel in the subcarrier.

15. The method of claim 10, further comprising pressing a flange key attached to the carrier assembly against an edge of a recess defined by the subcarrier to rotate the subcarrier while the wafer is pressed against the polishing pad.

* * * * *